US012714270B2

(12) United States Patent
Park

(10) Patent No.: US 12,714,270 B2
(45) Date of Patent: Aug. 25, 2026

(54) SELF-CLOSING CAP FOR PREVENTING WET WIPES FROM DRYING OUT

(71) Applicant: Gyu Jin Park, Seoul (KR)

(72) Inventor: Gyu Jin Park, Seoul (KR)

(73) Assignee: Gyu Jin Park, Seoul (KR)

( * ) Notice: Subject to any disclaimer, the term of this patent is extended or adjusted under 35 U.S.C. 154(b) by 0 days.

(21) Appl. No.: 18/708,148

(22) PCT Filed: Nov. 11, 2022

(86) PCT No.: PCT/KR2022/017712

§ 371 (c)(1),
(2) Date: May 7, 2024

(87) PCT Pub. No.: WO2023/085836

PCT Pub. Date: May 19, 2023

(65) Prior Publication Data

US 2025/0025000 A1 Jan. 23, 2025

(30) Foreign Application Priority Data

Nov. 15, 2021 (KR) ..... 10-2021-0156682

(51) Int. Cl.

| | |
|---|---|
| ***A47K 10/42*** | (2006.01) |
| ***A47K 10/32*** | (2006.01) |
| ***B65D 43/16*** | (2006.01) |
| ***B65D 43/22*** | (2006.01) |

(52) U.S. Cl.

CPC ..... *A47K 10/421* (2013.01); *B65D 43/163* (2013.01); *B65D 43/22* (2013.01); *A47K 2010/3266* (2013.01)

(58) Field of Classification Search

CPC .. B65D 43/22; B65D 43/163; B65D 47/0809; B65D 47/0823; A47K 10/421; A47K 2010/3266

USPC ..... 220/827, 220–380; 206/494

See application file for complete search history.

(56) References Cited

U.S. PATENT DOCUMENTS 214,169 A * 4/1879 Merrill ..... B65D 85/12 16/72
2,088,171 A * 7/1937 Kaufman ..... B65D 5/6611 229/125
2,127,911 A * 8/1938 Goss ..... B65D 47/286 222/561
2,303,147 A * 11/1942 Tinnerman ..... E05F 1/1284 220/827

(Continued)

FOREIGN PATENT DOCUMENTS

JP 2001-048210 A 5/2007
KR 20-0331744 Y1 11/2003

(Continued)

*Primary Examiner* — Chun Hoi Cheung
(74) *Attorney, Agent, or Firm* — NSIP Law

(57) ABSTRACT

One embodiment of the present disclosure relates to a self-closing cap which uses a hanger and an elastic material for self-closure, after injection molding a mold in a structure of a conventional wet wipes cap that is manually opened and closed and may remain open after use, so as to prevent drying and contamination of wet wipes and thus extend the shelf life of wet wipes and reduce the occasion of using an excessive amount of water during production of wet wipes to prevent drying.

8 Claims, 3 Drawing Sheets

(56) References Cited

U.S. PATENT DOCUMENTS 2,752,106 A * 6/1956 Thompson ..... A61F 15/002 242/588
3,120,879 A * 2/1964 Warner ..... F16N 21/02 220/326
3,792,803 A * 2/1974 Kessler ..... B65D 47/286 220/348
4,034,926 A * 7/1977 Wegner ..... B65D 85/672 220/4.23
4,354,611 A * 10/1982 Propst ..... B65F 1/1473 16/225
4,462,181 A * 7/1984 Broman ..... A01M 23/18 43/61
4,927,047 A * 5/1990 Stuber ..... B65D 81/3879 206/805
5,609,277 A * 3/1997 McDonald ..... A47G 23/0225 224/148.1
6,039,207 A * 3/2000 Adamek ..... B65D 81/3879 220/837
6,648,158 B1 * 11/2003 Lawrence ..... B65D 55/16 220/348
6,702,109 B1 * 3/2004 Tabuchi ..... B65D 75/5838 53/133.4
7,770,749 B2 * 8/2010 Lin ..... B65F 1/1623 220/254.5
9,327,892 B2 * 5/2016 Rubo ..... B65D 75/5838
10,750,892 B1 * 8/2020 Wegner ..... F25D 3/08
2002/0017522 A1 * 2/2002 Bando ..... B65D 83/0805 220/827
2014/0305819 A1 * 10/2014 Hill ..... A47K 10/426 206/233

FOREIGN PATENT DOCUMENTS

KR 10-0490872 B1 5/2005
KR 20-0473610 Y1 7/2014
KR 20-2015-0002211 U 6/2015
KR 10-2459342 B1 10/2022

* cited by examiner

【FIG. 1】
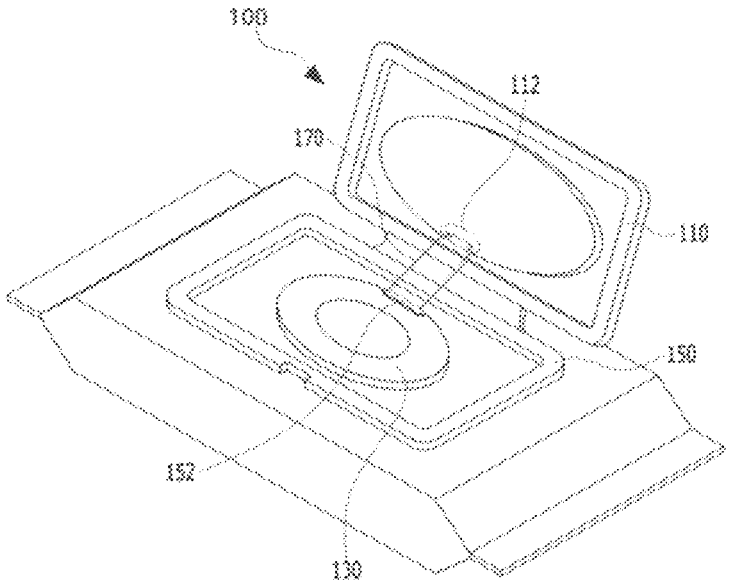
【FIG. 2】
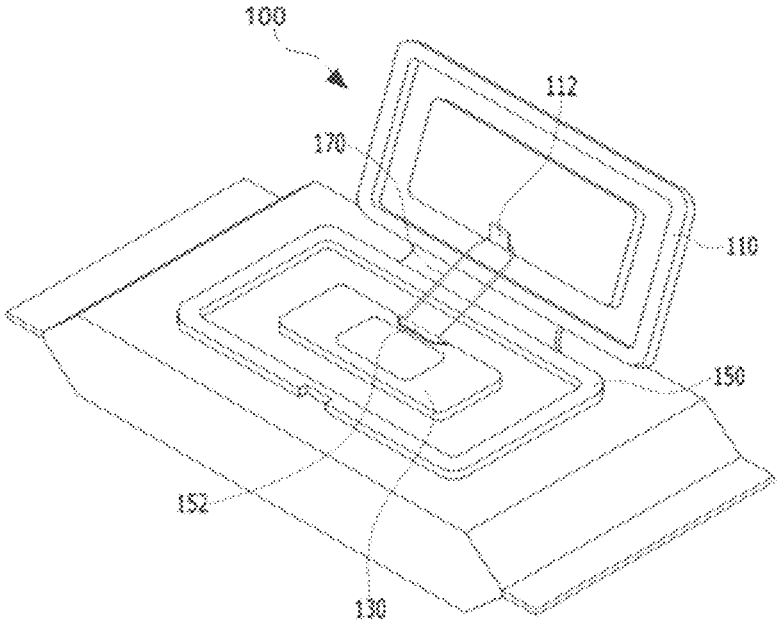

【FIG. 3】
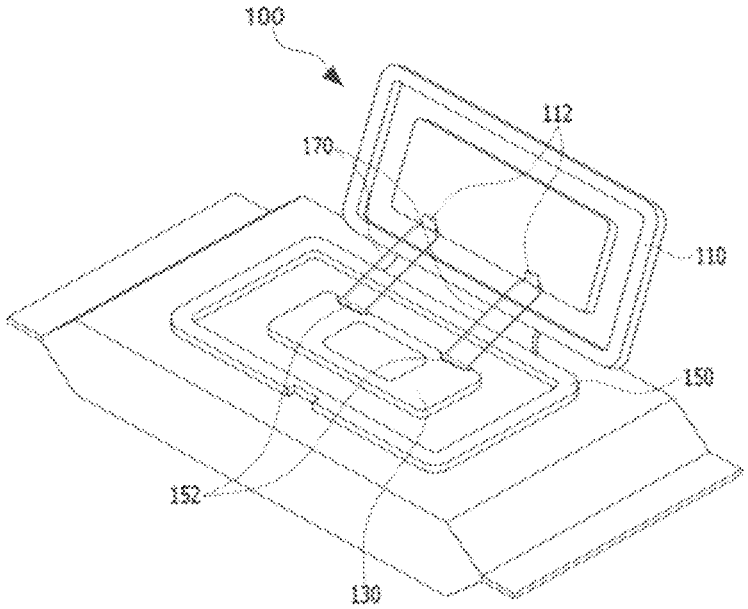
【FIG. 4】
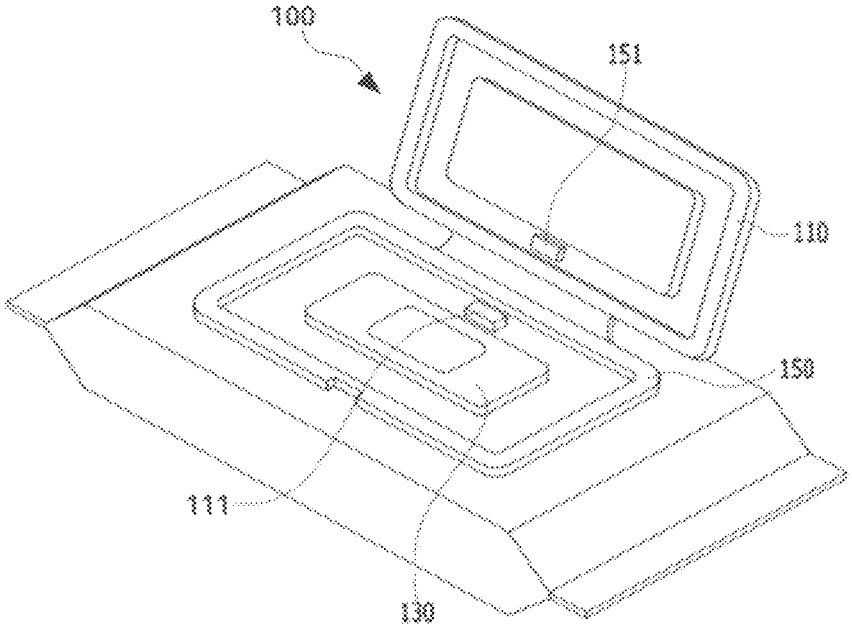

【FIG. 5】
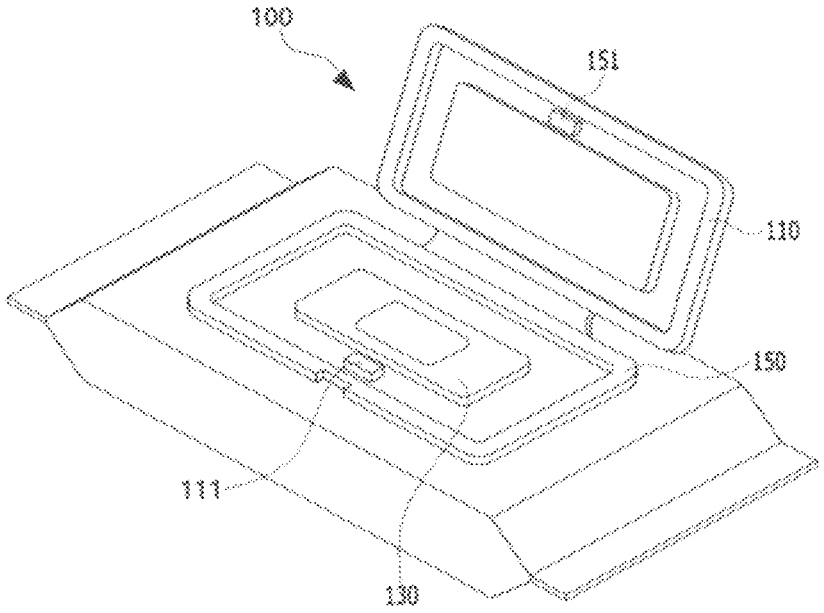
【FIG. 6】
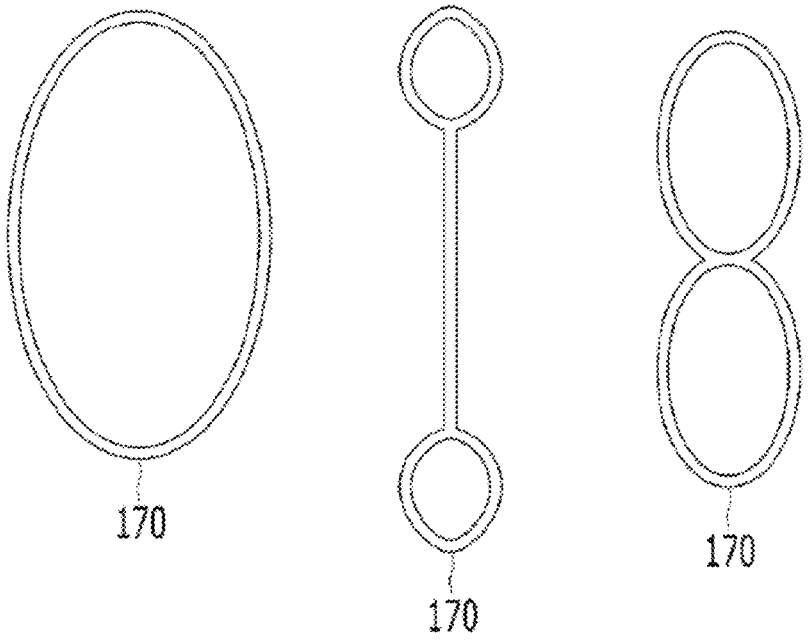

SELF-CLOSING CAP FOR PREVENTING WET WIPES FROM DRYING OUT

CROSS REFERENCE TO RELATED APPLICATIONS

This application is a U.S. National Stage Application of International Application No. PCT/KR2022/017712, filed on Nov. 11, 2022, which claims the benefit under 35 USC 119(a) and 365(b) of Korean Patent Application No. 10-2021-0156682, filed on Nov. 15, 2021, in the Korean Intellectual Property Office, the entire disclosure of which is incorporated herein by reference for all purposes.

TECHNICAL FIELD

The present disclosure relates to a self-closing cap system using an elastic material, and more particularly, to a self-closing cap for wet wipes that is made with a cap mold having a hanger of a product to make the cap self-closing using the hanger together with an elastic material after use to prevent the wet wipes from getting contaminated and drying out.

BACKGROUND ART

In general, wet wipes are produced by forming synthetic fibers, viscos fibers, cotton fibers, cellulose fibers and natural plant fibers into thin sheets of tissues, followed by addition of water and sterilization, and they keep hands and faces clean wherever users are, and recently, they are widely used to cleanse the skin of infants when replacing diapers. Additionally, the commonly used wet wipes are stored in a container such as a vinyl packaging to prevent water evaporation and make it easy to carry with, and the commonly used wet wipe container stores wet wipes in a folded state inside, and includes a casing having a hole through which wet wipes come out; and an adhesive sheet attached to the upper surface of the casing to open and close the hole. However, as the adhesive sheet repeatedly opens and closes the hole, the adhesive strength becomes weaker, failing to fully close the hole and there is inconvenience of having to pull the sheet to open the hole, so products further including a cover having a lid attached to the top of the casing to open and close one side of the upper surface having the hole has been developed in recent years. However, the existing lid products for wet wipes need to open the cover with both hands, causing inconvenience of use in a situation in which only one hand is free to open the cover, for example, because of holding a baby with the other hand. The existing wet wipe cap has a structure in which unless it is snugly closed after use, it is left open and water present in wet wipes evaporates, so there is a need for a wet wipe cap that closes by itself to prevent the cap from being left open after use, and to meet the need, a cap is made using a mold added with different types of hanger parts to the shape of the existing cap and a control system makes the cap self-closing using a suitable elastic material or magnetic material for the hanger, thereby preventing contamination of wet wipes or water evaporation that occurs when the cap is left open after use. Additionally, this hanging method may be applied to different types of caps, thereby ensuring compatibility with the existing products, and any additional mold making cost is not incurred, thereby ensuring cost efficiency. The newly made mold is made by modifying the hanger part, and thus does not require any additional cost and the existing mold can be re-used because only the hanger part is modified, leading to cost efficiency and the use of the hanger eliminates the need to attach the elastic material to the cap, so different types of elastic materials can be used. Additionally, any readily available elastic material (rubber bands, rubber banks, hair bands, etc.) may be used without needing to provide an elastic material.

Different types of wet wipe caps have been manufactured and put on the market, such as double covering the boundary between a cap snap fit and an area in which a sticker for a wet wipe hole is used or closed inside the cap and using water more than the appropriate amount in the production process to compensate for the loss of moisture, but the problem with drying out wet wipes was not thoroughly solved.

DETAILED DESCRIPTION

Technical Problem

The present disclosure is directed to providing a self-closing cap system including a wet wipe cap that is open and closed manually, and a hanger and an elastic material to make the cap self-closing to prevent wet wipes from getting contaminated with impurities and drying out so as to extend the lifespan of the wet wipes and reduce the amount of water used in the production process to compensate for the loss of moisture.

The technical problems to be solved by the present disclosure are not limited to the above-mentioned technical problems, and these and other technical problems will be clearly understood by persons having ordinary skill in the technical field pertaining to the present disclosure from the following description.

Technical Solution

To solve the above-described technical problem, an embodiment of the present disclosure provides a self-closing cap for preventing wet wipes from drying out based on a system in which the cap is made using a mold having a hanger and has an elastic material having proper elasticity to make the cap self—closing, in combination with a magnet having magnetism to allow a user to easily open the cap to use the wet wipes and make the cap close by itself after use, in order to prevent water evaporation when left open in case the cap is not fully closed by the elasticity of plastics conventionally used, thereby reducing the use of more water than normal in the production process, preventing wastage of wet wipes due to contamination or evaporation and extending the lifespan of the wet wipes.

Advantageous Effects

According to an embodiment of the present disclosure, when the self-closing cap for wet wipes is used, it may be possible to eliminate the need to close the cap after use, thereby ensuring convenience of use, and to prevent wet wipes from getting contaminated with impurities and drying out, thereby preventing wastage of wet wipes, as well as removing the need for snap fits and stickers of the existing caps and reducing the amount of water for preventing wet wipes from drying out in the production process.

The effects of the present disclosure are not limited to the above-described effects, and it should be understood that the effects of the present disclosure include all effects that can be inferred from the subject matter set forth in the detailed description of the present disclosure or the appended claims.

DESCRIPTION OF DRAWINGS

FIG. 1 is a perspective view including a hanger of a self-closing cap for preventing wet wipes from drying out according to an embodiment of the present disclosure.

FIG. 2 is a perspective view including another type of hanger in a self-closing cap for preventing wet wipes from drying out according to an embodiment of the present disclosure.

FIG. 3 is a perspective view including another type of hanger in a self-closing cap for preventing wet wipes from drying out according to an embodiment of the present disclosure.

FIG. 4 is a perspective view including a magnet of a self-closing cap for preventing wet wipes from drying out according to an embodiment of the present disclosure.

FIG. 5 is a perspective view including another type of magnet in a self-closing cap for preventing wet wipes from drying out according to an embodiment of the present disclosure.

FIG. 6 is a perspective view of an elastic element used for self-closing to prevent wet wipes from drying out according to an embodiment of the present disclosure.

BEST MODE

Hereinafter, the present disclosure will be described with reference to the accompanying drawings. However, the present disclosure may be embodied in many different forms and accordingly is not limited to the disclosed embodiments. For clarity of description, in the drawings, some irrelevant elements are omitted, and like reference numerals are affixed to like elements throughout the specification.

It should be understood that when an element is referred to as being "connected to (linked to, contact with, coupled to)" another element, it can be directly connected to the other element or intervening elements may be present. Additionally, the term "comprises" specifies the presence of stated elements, but does not preclude the presence or addition of one or more other elements unless the context clearly indicates otherwise.

The terms used herein are used to describe a particular embodiment but not intended to limit the present disclosure. Unless the context clearly indicates otherwise, singular forms include plural forms. The term "comprising" or "including" when used in this specification, specifies the presence of stated features, integers, steps, operations, elements, components or a combination thereof, but does not preclude the presence or addition of one or more other features, integers, steps, operations, elements, components or a combination thereof.

An embodiment of the present disclosure will be described in detail with reference to the accompanying drawings below.

FIG. 1 is a perspective view including a hanger of a self-closing cap for preventing wet wipes from drying out according to an embodiment of the present disclosure, FIG. 2 is a perspective view including the hanger of the self-closing cap for preventing wet wipes from drying out according to an embodiment of the present disclosure, FIG. 3 is a perspective view including the hanger of the self-closing cap for preventing wet wipes from drying out according to an embodiment of the present disclosure, FIG. 4 is a perspective view including a magnet of the self-closing cap for preventing wet wipes from drying out according to an embodiment of the present disclosure, FIG. 5 is a perspective view including the magnet of the self-closing cap for preventing wet wipes from drying out according to an embodiment of the present disclosure, and FIG. 6 is a perspective view of an elastic element used for self-closing to prevent wet wipes from drying out according to an embodiment of the present disclosure.

Referring to FIGS. 1 and 2, the self-closing cap 100 for preventing wet wipes from drying out according to an embodiment of the present disclosure is a self-closing wet wipe cap system using a hanger and an elastic material, wherein the hanger may be formed at any location of the entire surface of the cap and different types of elastic materials may be hung on the hanger. The hanger may include one or more hangers that may be made by molding and installed over the entire surface of the cap. The elastic material may be hung on the hanger or coupled to the hanger by clicking or adhesion and different types of elastic materials may be used. The elastic material may include rubber bands, rubber banks, hair bands and springs that are easy to get. The self-closing cap system may work with a magnetic material having magnetism and may interact with the existing double cover screen to form a perfect seal when closing. A frame into which the magnetic material having magnetism is inserted may be made together when making the cap mold without any extra cost. The double cover screen may be used to prevent wet wipes from drying out in the existing wet wipe cap products.

According to an embodiment of the present disclosure, the self-closing cap 100 for preventing wet wipes from drying out may include a base 150 that is tightly installed on the upper surface of a wet wipe packaging film pack, attached to the wet wipe packaging film pack, and secured to the film pack and connected to a cover 110 at the same time, the cover 110 that is connected to the base 150 and determines whether to open or close the wet wipe packaging film pack, an outlet 130 that is formed inside of the base 150 and located at an inlet through which wet wipes come out, a first magnet 111 that is formed at one side of the inner surface of the base 150 and gets involved in opening and closing of the cover 110, a second magnet 151 that is formed at one side of the inner surface of the cover 110 and gets involved in opening and closing of the cover 110, a first hanger 112 formed at one side of the inner surface of the cover 110, a second hanger 152 formed at one side of the inner surface of the base 150, and an elastic element that is connected to the first hanger 112 and the second hanger 152 to form a primary driving force to the closing of the cover 110. The first magnet 111 and the second magnet may include a plurality of first magnets and a plurality of second magnets, and may be attached to the cover 110 and the base 150 at different locations.

The first hanger 112 according to an embodiment of the present disclosure may be present at one side of the inner surface of the cover 110, and in another type of self-closing cap for preventing wet wipes from drying out, may include a plurality of first hangers 112 and be connected to the elastic element 170.

The second hanger 152 according to an embodiment of the present disclosure may be formed at one side of the inner surface of the outlet 130, and in another type of self-closing cap 100 for preventing wet wipes from drying out, may include a plurality of second hangers 152 and be connected to the elastic element 170. The first hanger 112 and the second hanger 152 may come in different shapes and sizes, and be installed using the plurality of first hangers 112 and the plurality of second hangers 152.

The elastic element 170 according to an embodiment of the present disclosure may be formed in different shapes including an oval or elliptical shape, an 8 shape, etc., and may adjust the extent of closure of the self-closing cap 100 for preventing wet wipes from drying out with varying elasticity for each different shape.

The elastic element according to an embodiment of the present disclosure may be formed in different shapes including an oval or elliptical shape, an 8 shape, etc., and may adjust the extent of closure of the self-closing cap 100 for preventing wet wipes from drying out with varying elasticity for each different shape.

The outlet 130 according to an embodiment of the present disclosure may be present inside of the base 150 and secured to the film pack at the same time and may form different types of second hangers 152.

The present disclosure has been hereinabove described by way of illustration, and persons having ordinary skill in the technical field pertaining to the present disclosure will understand that the present disclosure may be easily modified in other specific forms without any change to the technical spirit or essential features of the present disclosure. Therefore, it should be understood that the above-described embodiments are illustrative and not limitative in all aspects. For example, each element described in singular form may work in a distributed manner, and likewise, elements described as being distributed may work in combination.

The scope of the present disclosure is defined by the appended claims, and it should be interpreted that all changes or modifications derived from the meaning and scope of the appended claims and their equivalent concept are included in the scope of the present disclosure.

The invention claimed is:

1. A self-closing cap for preventing wet wipes from drying out, which is tightly installed on an upper surface of a wet wipe packaging film pack, the self-closing cap comprising:

a base attached and secured to the wet wipe packaging film pack;

a cover connected to the base and configured to open or close the wet wipe packaging film pack;

a first hanger disposed at one side of an inner surface of the cover;

a second hanger disposed at one side of an inner surface of the base; and an elastic element hung on the first hanger and the second hanger to provide a primary driving force for closing the cover.

2. The self-closing cap for preventing wet wipes from drying out according to claim 1, wherein the first hanger includes a plurality of first hangers.

3. The self-closing cap for preventing wet wipes from drying out according to claim 1, wherein the second hanger includes a plurality of second hangers.

4. The self-closing cap for preventing wet wipes from drying out according to claim 1, wherein a shape of the elastic element is selected from the group consisting of an oval shape, elliptical shape, and a figure-eight shape.

5. The self-closing cap for preventing wet wipes from drying out according to claim 1, further comprising an outlet formed inside the base and located at an opening of the wet wipe packaging film pack through which wet wipes come out.

6. The self-closing cap for preventing wet wipes from drying out according to claim 1, wherein the first hanger and the second hanger are formed by molding.

7. A self-closing cap for preventing wet wipes from drying out, which is tightly installed on an upper surface of a wet wipe packaging film pack, the self-closing cap comprising:

a base attached to the wet wipe packaging film pack and secured to the film pack;

a cover connected to the base and configured to open and close the wet wipe packaging film pack;

a first hanger formed at one side of an inner surface of the cover;

a second hanger formed at one side of an inner surface of the base; and an elastic element hung on the first hanger and the second hanger to provide a primary driving force for closing the cover, wherein the second hanger is disposed between a hinge portion connecting the cover and the base and an opening of the wet wipe packaging film pack through which wet wipes come out.

8. The self-closing cap for preventing wet wipes from drying out according to claim 7, wherein the first hanger and the second hanger are formed by molding.

* * * * *